US010135196B2

(12) United States Patent
Wen et al.

(10) Patent No.: US 10,135,196 B2
(45) Date of Patent: Nov. 20, 2018

(54) ELECTRICAL CONNECTOR HAVING IMPROVED CONDUCTIVE TERMINALS

(71) Applicant: FOXCONN INTERCONNECT TECHNOLOGY LIMITED, Grand Cayman (KY)

(72) Inventors: Wei Wen, Huaian (CN); Jun Zhao, Huaian (CN); Jin-Guo Qiu, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/638,402

(22) Filed: Jun. 30, 2017

(65) Prior Publication Data

US 2018/0006408 A1 Jan. 4, 2018

(30) Foreign Application Priority Data

Jun. 30, 2016 (CN) ..... 2016 1 0497327

(51) Int. Cl.
*H01R 13/648* (2006.01)
*H01R 24/00* (2011.01)
(Continued)

(52) U.S. Cl.
CPC ..... *H01R 13/6581* (2013.01); *H01R 13/6585* (2013.01); *H01R 13/6594* (2013.01);
(Continued)

(58) Field of Classification Search
CPC ... H01R 13/6581; H01R 12/724; H01R 24/60
See application file for complete search history.

(56) References Cited

U.S. PATENT DOCUMENTS 7,390,220 B1 * 6/2008 Wu ..... H01R 9/03 439/607.06
8,784,134 B2 * 7/2014 Wu ..... H01R 13/6598 439/607.05

(Continued)

FOREIGN PATENT DOCUMENTS

CN 204118317 U 1/2015
CN 204243365 U 4/2015

(Continued)

*Primary Examiner* — Xuong Chung Trans
(74) *Attorney, Agent, or Firm* — Wei Te Chung; Ming Chieh Chang

(57) ABSTRACT

An electrical connector includes: a terminal module comprising an insulative housing having a base portion and a tongue portion, an upper and a lower rows of conductive terminals, and a metallic shielding plate clamped between the two rows of conductive terminals; each row of conductive terminals including plural grounding terminals located on both sides of the tongue portion, and plural power terminals located on the inside of the grounding terminals; each conductive terminal having a contacting section, a tail section, and a retaining section; wherein an upper power terminal and a corresponding lower power terminal are an integral block structure and extending along a thickness direction of the tongue portion in the tongue portion, a thickness of the contacting section of each power terminal is at least twice the thickness of the contacting section of each grounding terminal.

20 Claims, 12 Drawing Sheets

(51) Int. Cl.

| | |
|---|---|
| ***H01R 13/6581*** | (2011.01) |
| ***H01R 13/6585*** | (2011.01) |
| ***H01R 13/6594*** | (2011.01) |
| ***H01R 24/62*** | (2011.01) |
| ***H01R 24/60*** | (2011.01) |
| *H01R 12/72* | (2011.01) |
| *H01R 107/00* | (2006.01) |

(52) U.S. Cl.
CPC ..... *H01R 24/60* (2013.01); *H01R 24/62* (2013.01); *H01R 12/721* (2013.01); *H01R 12/724* (2013.01); *H01R 2107/00* (2013.01)

(56) References Cited

U.S. PATENT DOCUMENTS

| | | | | |
|---|---|---|---|---|
| 9,728,916 | B1 * | 8/2017 | Tsai | H01R 24/60 |
| 2016/0093994 | A1 * | 3/2016 | Chen | H01R 12/724 439/607.01 |
| 2016/0352052 | A1 * | 12/2016 | Yu | H01R 13/6585 |
| 2017/0018883 | A1 * | 1/2017 | Chen | H01R 24/62 |

FOREIGN PATENT DOCUMENTS

| | | | |
|---|---|---|---|
| CN | 104810657 | A | 7/2015 |
| CN | 204696302 | U | 10/2015 |
| CN | 105024197 | A | 11/2015 |
| CN | 205122849 | U | 3/2016 |
| CN | 105552618 | A | 5/2016 |

* cited by examiner

ELECTRICAL CONNECTOR HAVING IMPROVED CONDUCTIVE TERMINALS

BACKGROUND OF THE INVENTION

1. Field of the Invention

The present invention relates to an electrical connector, and more particularly to an electrical connector adapted for being normally and reversely mated with a complementary connector.

2. Description of Related Art

China Patent No. 204696302, issued on Oct. 7, 2015, discloses an electrical connector adapted for being normally and reversely mated with a complementary connector. The electrical connector has an insulative housing provided with a tongue portion, an upper row of terminals, a lower row of terminals, and a metallic plate provided with a pair of thickening portions. The thickening portions cover the both sides of the tongue portion and are adapted to be a plurality of grounding terminals. China Patent No. 205122849, issued on Mar. 30, 2016, discloses another electrical connector adapted for being normally and reversely mated with a complementary connector. The electrical connector has an insulative housing provided with a tongue portion, an upper and lower rows of terminals retained in the insulative housing. In one embodiment, a power terminal is of an integral block structure shared by or common to both the upper and lower rows. A vertical dimension of the common power terminal is equal to or greater than a thickness of the tongue portion.

An electrical connector having a power terminal formed into a block structure and a metallic shielding plate clamped between the grounding terminals of the two rows of conductive terminals is desired.

SUMMARY OF THE INVENTION

An electrical connector comprises: a terminal module comprising an insulative housing provided with a base portion and a tongue portion, an upper row of conductive terminals and a lower row of conductive terminals retained to the insulative housing, and a metallic shielding plate clamped between the upper and lower rows of conductive terminals; each row of conductive terminals comprising a plurality of grounding terminals located on both sides of the tongue portion along a transverse direction, and a plurality of power terminals located on the inside of the grounding terminals; each conductive terminal having a contacting section exposed to a surface of the tongue portion, a tail section, and a retaining section connecting the contacting section and the tail section; wherein an upper power terminal and a corresponding lower power terminal are an integral block structure and extending along a thickness direction of the tongue portion in the tongue portion, a dimension of the contacting section of each power terminal in the thickness direction of the tongue portion, is at least twice the thickness of the contacting section of each grounding terminal.

Other novel features of the invention will become more apparent from the following detailed description when taken in conjunction with the accompanying drawings.

DETAILED DESCRIPTION OF THE PREFERRED EMBODIMENT

Figure 1:
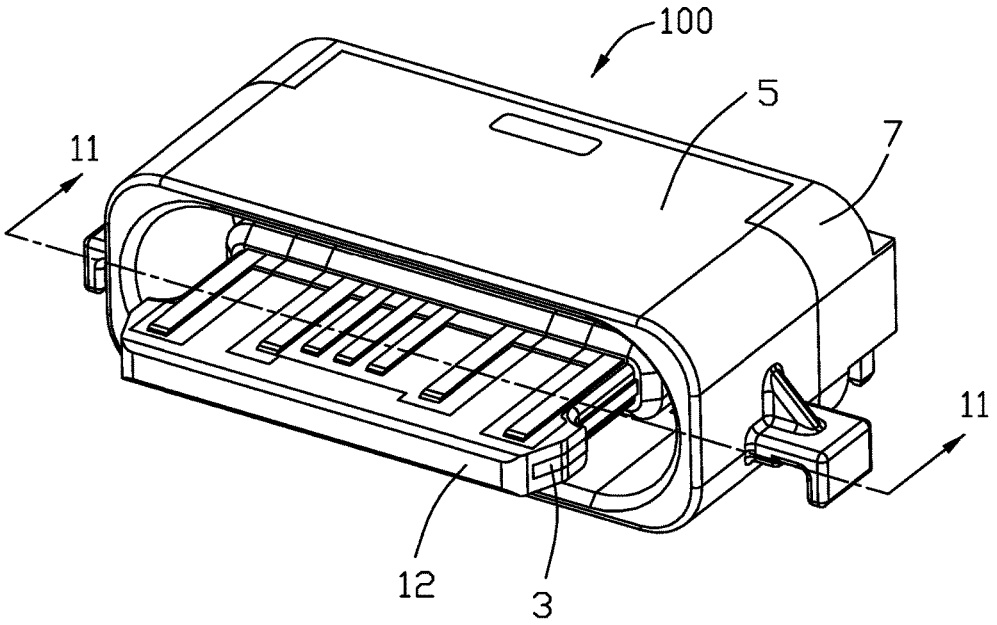
FIG. 1 is an assembled perspective view of the electrical connector of a preferred embodiment of the instant invention.
Figure 2:
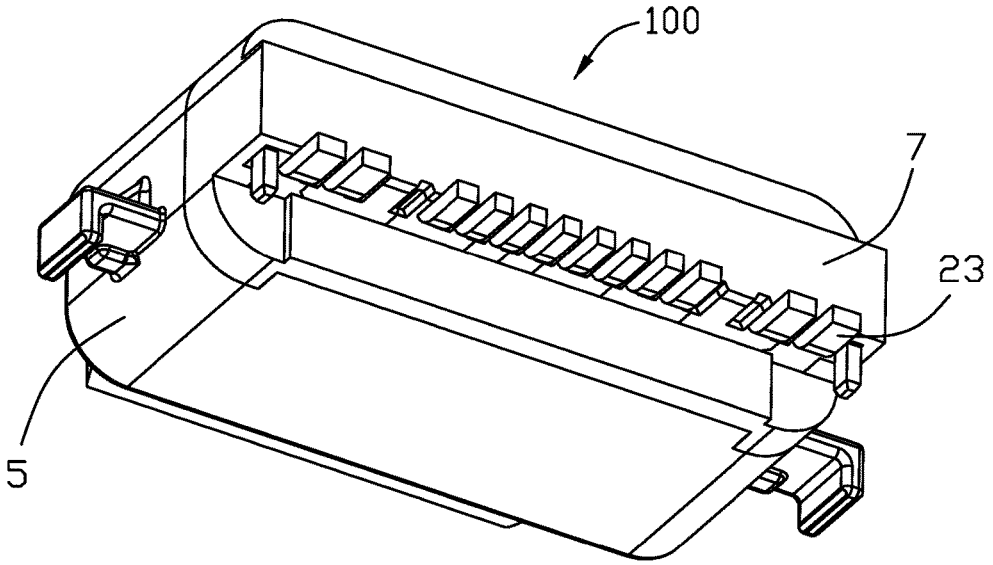
FIG. 2 is an assembled perspective view of FIG. 1 seen from another direction.
Figure 3:
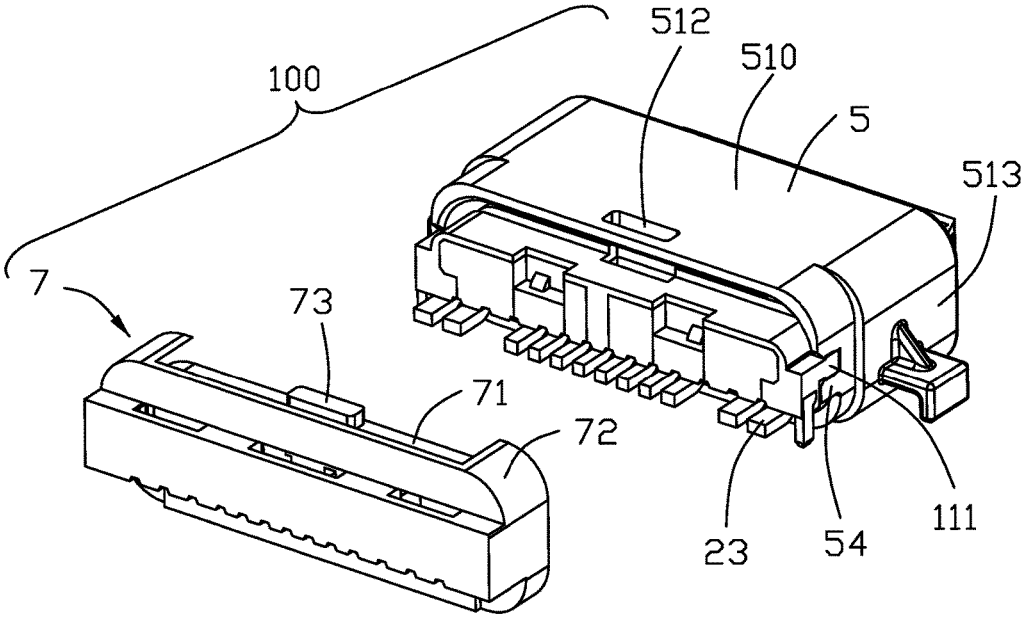
FIG. 3 is a partially exploded perspective view of the separation of a sealer by the electrical connector of FIG. 2 of a preferred embodiment of the instant invention.
Figure 4:
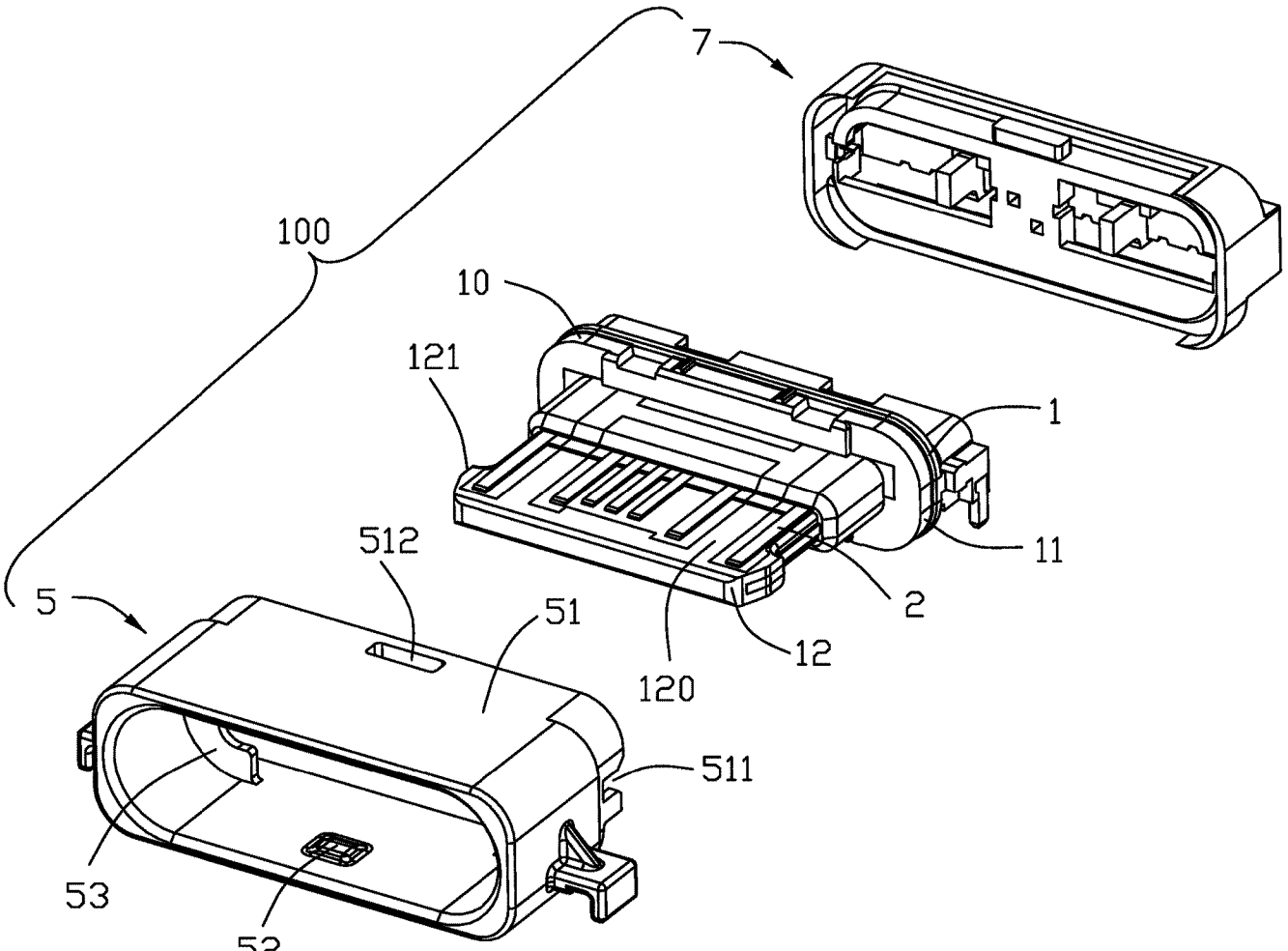
FIG. 4 is a partially exploded perspective view of the separation of a sealer, a metallic shell, and a terminal module by the electrical connector of a preferred embodiment of the instant invention.
Figure 5:
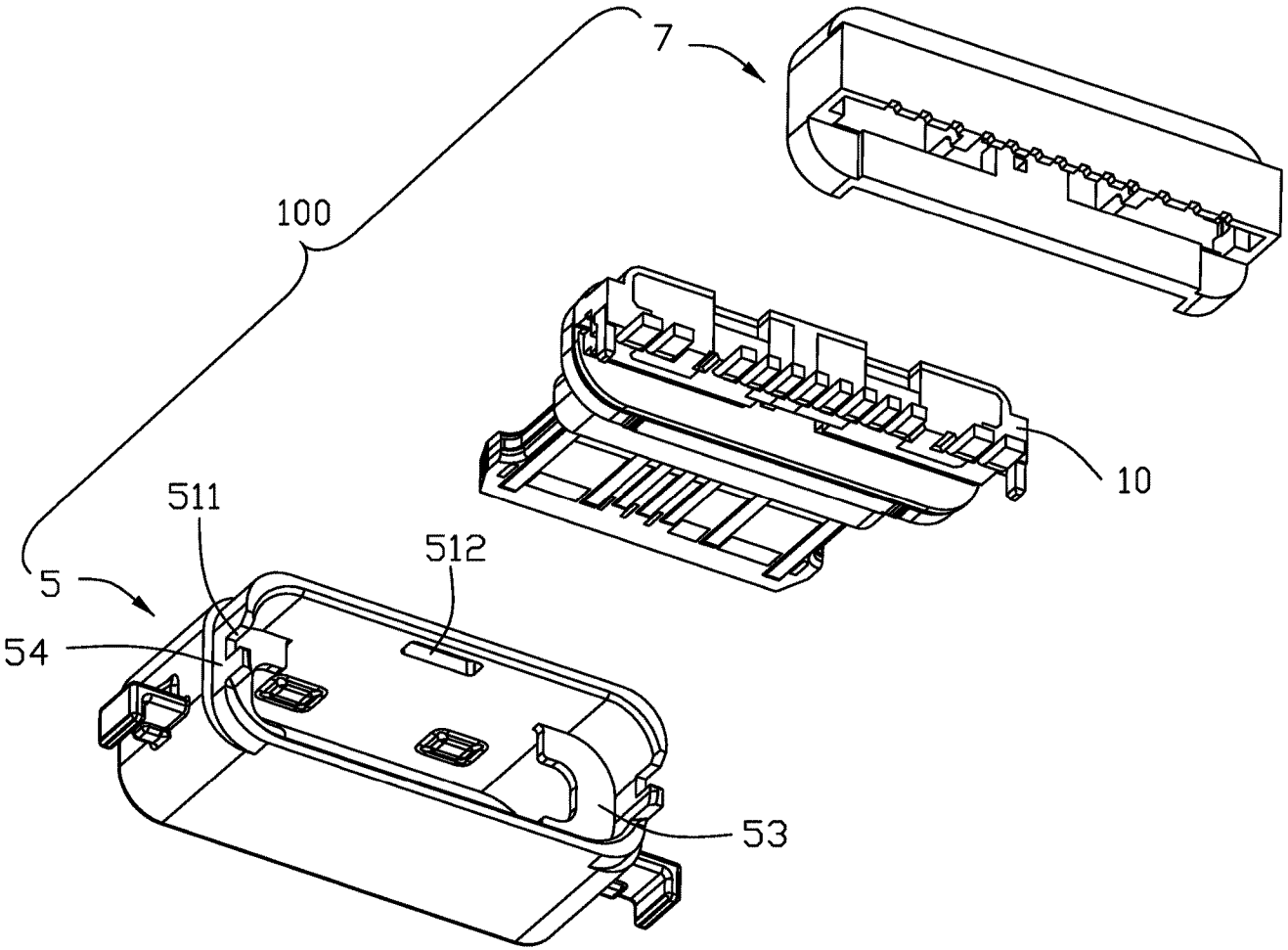
FIG. 5 is a partially exploded perspective view of FIG. 4 seen from another direction.
Figure 6:
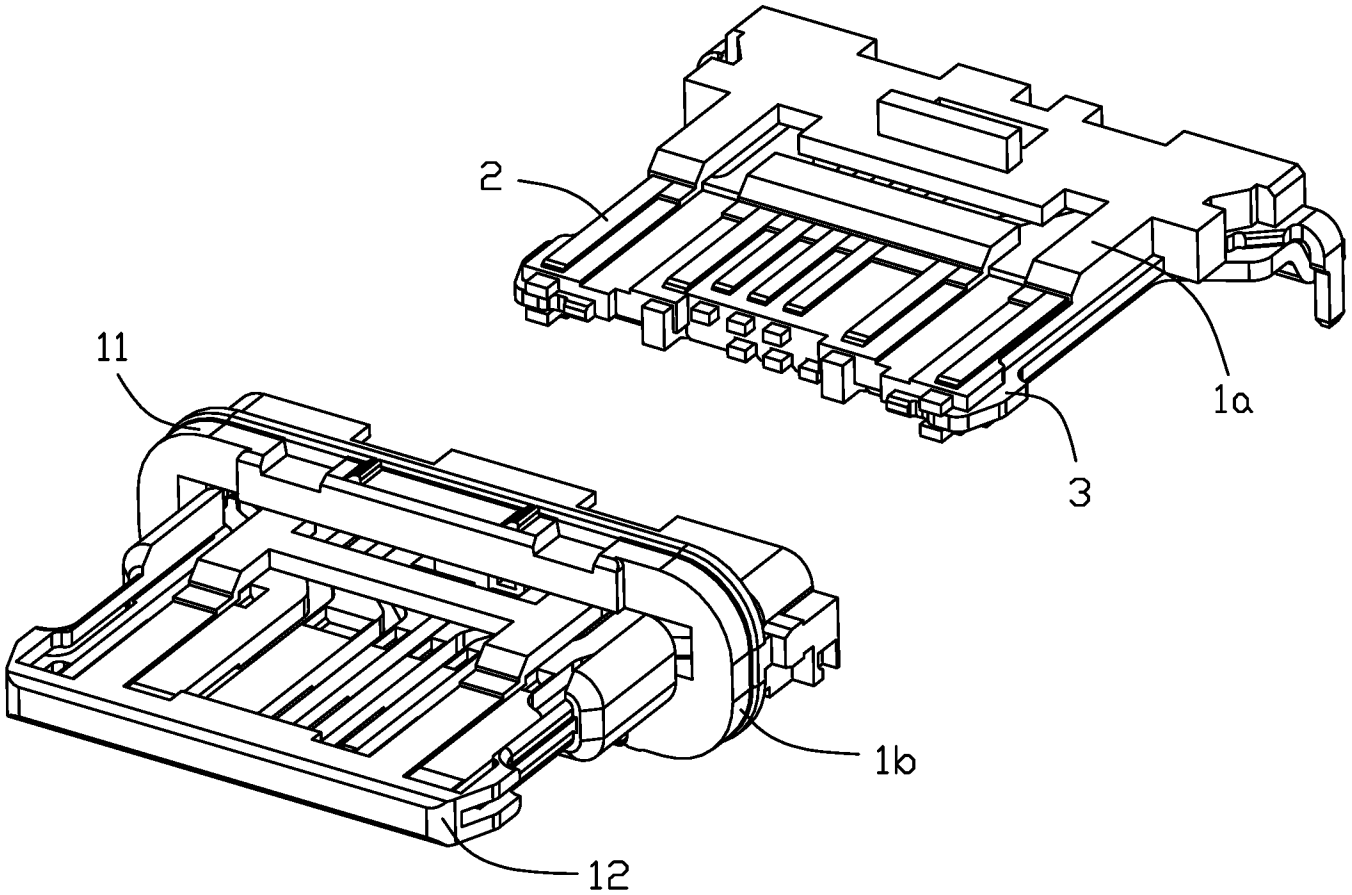
FIG. 6 is a partially exploded perspective view of a terminal module of FIG. 5.
Figure 7:
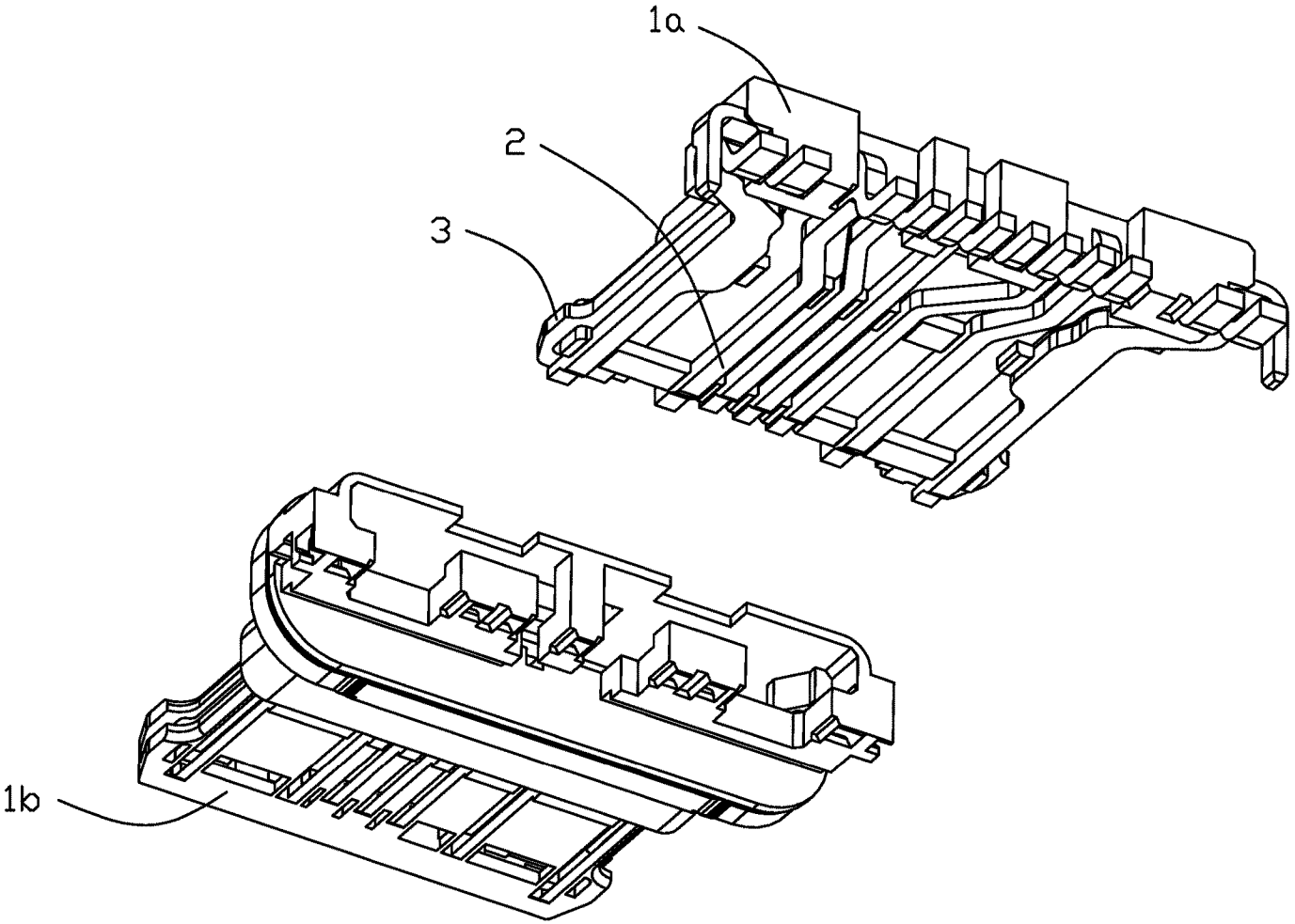
FIG. 7 is a partially exploded perspective view of FIG. 6 seen from another direction.
Figure 8:
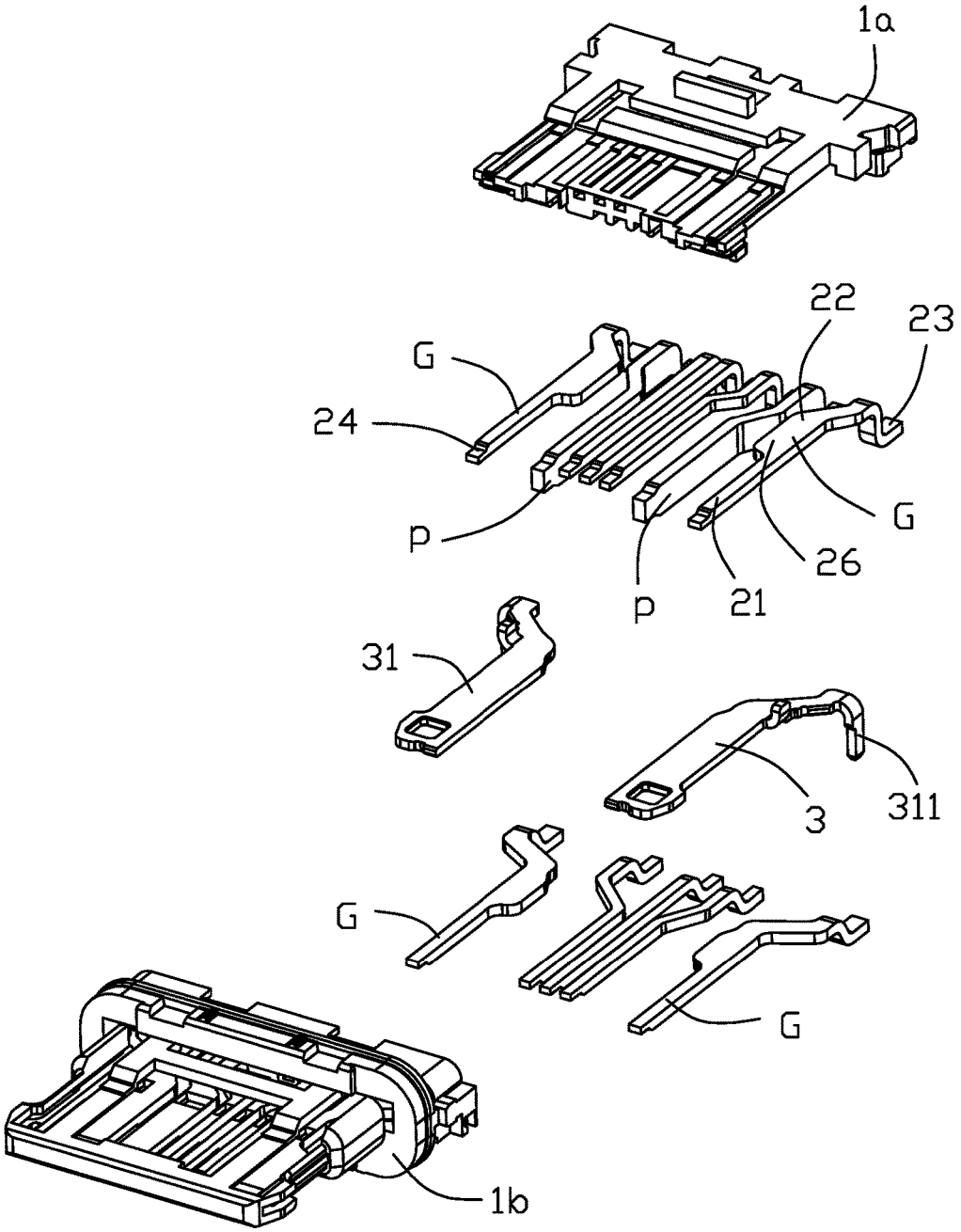
FIG. 8 is an exploded perspective view of a terminal module of a preferred embodiment of the instant invention.
Figure 9:
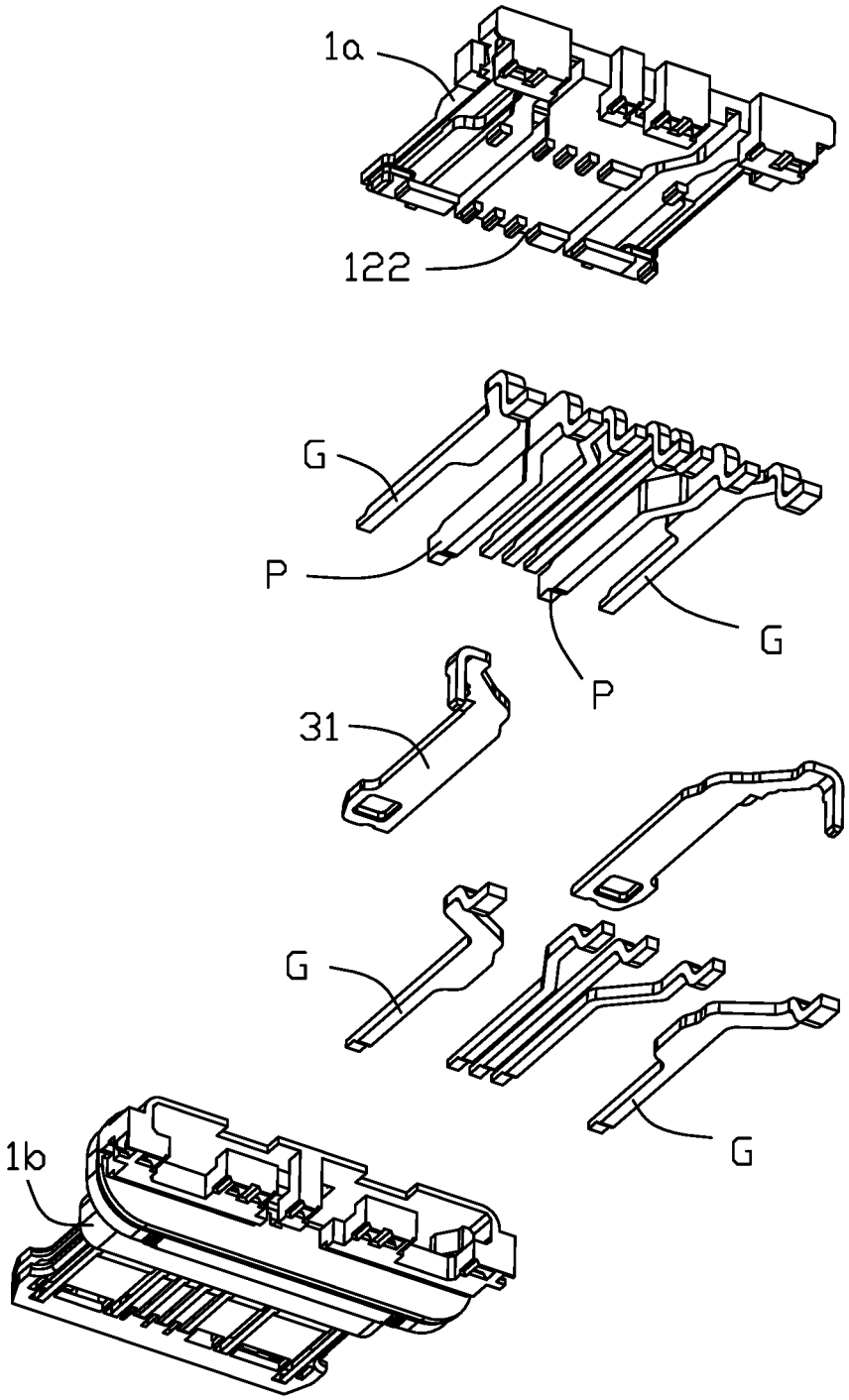
FIG. 9 is an exploded perspective view of FIG. 8 seen from another direction.
Figure 10:
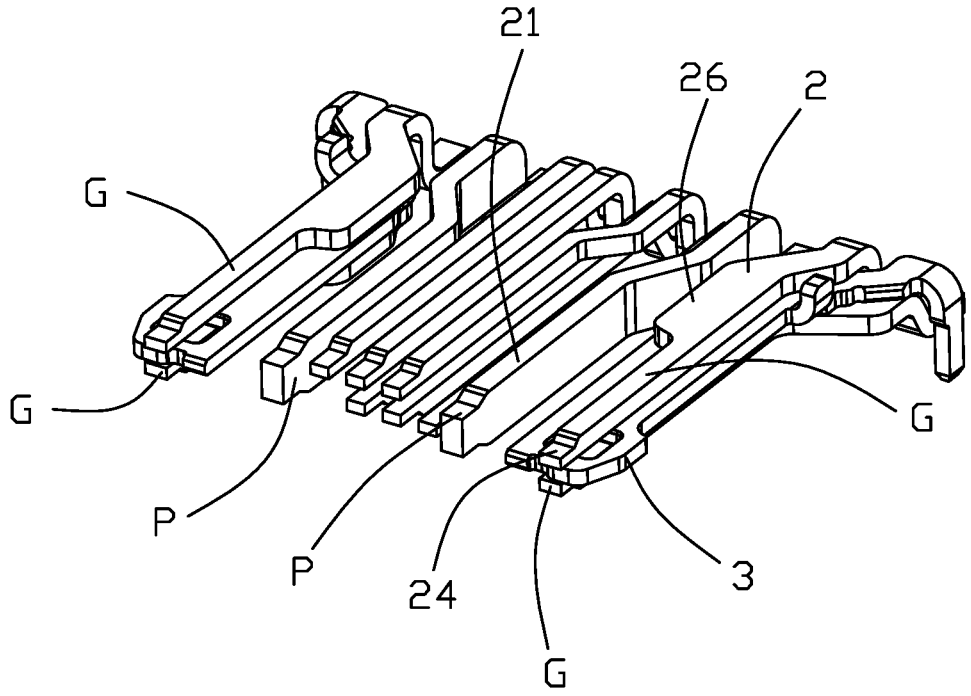
FIG. 10 is an assembled perspective view of conductive terminals and a metallic shielding plate of a preferred embodiment of the instant invention.

Reference will now be made in detail to the preferred embodiment of the present invention shown in FIGS. 1 to 11.

The electrical connector 100 has an insertion opening (not labeled) to mate a complementary plug connector (not shown). The electrical connector 100 has a front-to-rear direction, a transverse direction perpendicular to the front-to-rear direction, and a thickness direction (vertical direction) perpendicular to both the front-to-rear direction and the transverse direction, respectively. The electrical connector 100 defines the insertion opening at the front end thereof.

The electrical connector 100 of a preferred embodiment of the instant invention is a receptacle connector. The electrical connector 100 includes a terminal module 10, a metallic shell 5 assembled to an outside of terminal module 10, and a sealer 7.

The terminal module 10 includes an insulative housing 1 provided with a base portion 11 and a tongue portion 12, an upper row of conductive terminals 2 and a lower row of conductive terminals 2 retained to the insulative housing 1, and a metallic shielding plate 3 clamped between the upper and lower rows of conductive terminals 2. The two rows of conductive terminals 2 include a plurality of common terminals (not labeled) and are diagonally symmetrically arranged with each other.

The insulative housing 1 includes a body portion 1*a* and an insulator 1*b* integrated with the body portion 1*a*. The base portion 11 is formed by the rear ends of both the body portion 1*a* and the insulator 1*b*. The tongue portion 12 is formed by the extending forwardly portions (not labeled) of both the body portion 1*a* and the insulator 1*b*. The tongue portion 12 includes a pair of ear portions 121 projecting laterally from the both sides thereof. The rear end of the base portion 11 is provided with a pair of engagement portions 111 in an L-shape. The body portion 1*a* is provided with a plurality of terminal slots 122.

Each row of conductive terminals 2 include a plurality of grounding terminals G, a plurality of power terminals P, and a plurality of signal terminals (not labeled). Each conductive terminal 2 has a contacting section 21 exposed to a corresponding mating surface 120 of the tongue portion 12, an embedding section 24 extending forwardly from the contacting section 21 and formed by thinning, a tail section 23 soldered to a printed circuit board (not shown), and a retaining section 22 connecting the contacting section 21 and the tail section 23.

The upper row of conductive terminals 2 include two upper grounding terminals G located on both sides thereof along the transverse direction, and two upper power terminals P and a plurality of upper signal terminals (not labeled) located on the inside of the two upper grounding terminals G. The retaining section 22 of each upper grounding terminal G is provided with a widened section or angled deflection 26. The contacting section 21 and the retaining section 22 of each upper power terminal P are an upright shape whose thickness is larger than the width. The tail sections 23 of the upper power terminals P and the tail sections 23 of the other terminals 2 of the two rows of conductive terminals 2 are arranged in a row in a coplanar way.

The lower row of conductive terminals 2 include two lower grounding terminals G located on both sides thereof along a transverse direction, and a plurality of lower signal terminals (not labeled) located on the inside of the two lower grounding terminals G. The retaining section 22 of each lower grounding terminal G is provided with a widened section 26. Two lower power terminals P of the lower row of conductive terminals 2 and two corresponding upper power terminals P are an integral block structure respectively. An upper power terminal P and a corresponding lower power terminal P form a unitary power terminal P belonging to a common terminal. A cross section of each power terminal P is rectangular. A dimension of the contacting section 21 of each power terminal P in a thickness direction of the tongue portion 12, is not less than a thickness of the tongue portion 12. The dimension of the contacting section 21 of each power terminal P in the thickness direction of the tongue portion 12, is at least twice each thickness of the other terminals of conductive terminals 2.

The metallic shielding plate 3 includes a pair of flakes 31 which are provided separately. A rear end of each flake 31 is provided with a soldering leg 311 extending rearward and bending downwardly.

The metallic shell 5 includes a tubular main portion 51, and a plurality of grounding portions 52 protruding inwardly from the main portion 51. A pair of stopping portions 53 are provided on the inside of the main portion 51. The main portion 51 includes an upper wall 510, and a pair of side walls 513 on the both sides thereof. A rear edge of the main portion 51 is provided with a plurality of engagement slots 511 for opening rearward. The upper wall 510 is provided with a through hole 512. The rear side of the side walls 513 are provided with a retaining slot 54 penetrating with engagement slots 511.

The sealer 7 includes a pair of side securing portions 72, an upper securing portion 71 located between the pair of side securing portions 72, and a tuber 73 protruding upwardly from the upper securing portion 71.

Referring to FIGS. 1-11, the method of manufacturing the electrical connector 100 of the preferred embodiment of the instant invention includes the following steps:

The first step, two rows of conductive terminals 2 including the grounding terminals G and the power terminals P are punched out with a plurality of metal sheet (not shown). The power terminals P of the two rows of conductive terminals 2 are integrally formed into a block structure.

The second step, the upper row of conductive terminals 2 and the metallic shielding plate 3 are integrated with the body portion 1*a*. The embedding sections 24 of the upper row of conductive terminals 2 are retained in the body portion 1*a*.

The third step, the lower row of conductive terminals 2 are propped against the body portion 1*a* and are received in the plurality of terminal slots 122 of the body portion 1*a* respectively. Each flake 31 is clamped between an upper grounding terminal G and a corresponding lower grounding terminal G of the two rows of conductive terminals 2 and is in contact with the upper and lower grounding terminals G. Each flake 31 is separated from the power terminals P in the transverse direction.

The fourth step, the body portion 1*a* is integrated with the insulator 1*b* to form the insulative housing 1. The embedding sections 24 of the lower row of conductive terminals 2 are retained in the insulative housing 1. The two power terminals P are extending along a thickness direction of the tongue portion 12 in the tongue portion 12. The contacting sections 21 of the two power terminals P penetrate the metallic shielding plate 3 in the thickness direction. The dimension of the contacting section 21 of each power terminal P in the thickness direction of the tongue portion 12, is not less than the thickness of the tongue portion 12 to be exposed to two corresponding mating surfaces 120 of the tongue portion 12. An upper surface of the two power terminals P are exposed to a top surface of the tongue portion 12 so as to constitute the contacting sections 21 of upper power terminals P of the upper row of conductive terminals 2. A lower surface of the two power terminals P are exposed to a bottom surface of the tongue portion 12 so as to constitute the contacting sections 21 of lower power terminals P of the lower row of conductive terminals 2.

The fifth step, the metallic shell 5 is formed by metal injection molding. The terminal module 10 is assembled from rear to the inside of the metal shell 5. The base portion 11 of the terminal module 10 is attached to the stopping portions 53 of the metallic shell 5. The engagement portions 111 are mating with the engagement slots 511 respectively.

The sixth step, the sealer 7 is integrated with the terminal module 10 and the metallic shell 5 from the through hole 512 and is formed between the rear end of the body portion 1*a* and the metallic shell 5. The upper securing portion 71 of the sealer 7 is retaining in the inside of the upper wall 510 of the metallic shell 5. The tuber 73 of the sealer 7 is retaining in the through hole 512. The side securing portions 72 of the sealer 7 are retaining with the retaining slot 54 of the metallic shell 5 and are flush with the side walls 513 of the metallic shell 5.

Figure 11:
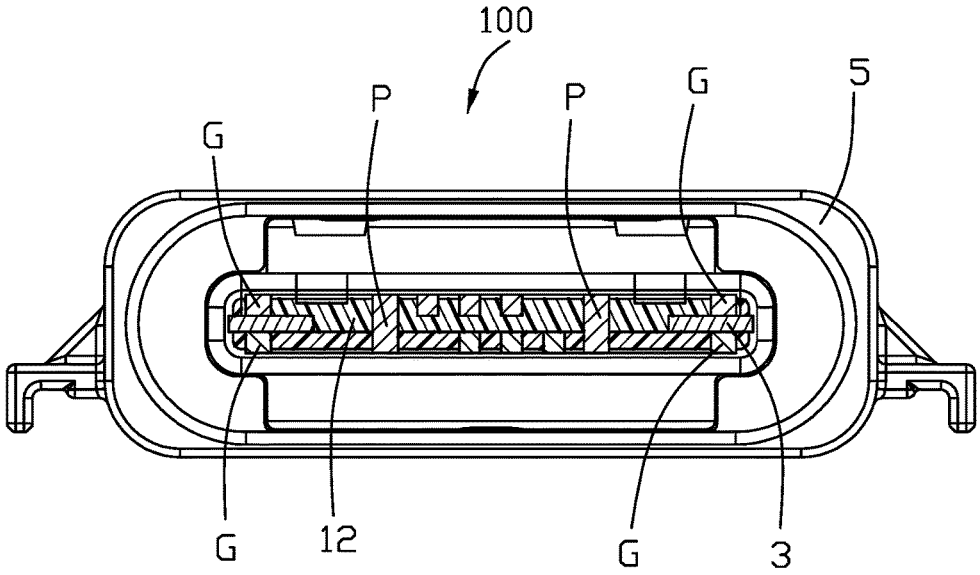
FIG. 11 is a cross-sectional view of the electrical connector of a preferred embodiment of the instant invention taken along line 11-11 of FIG. 1.
Figure 11A:
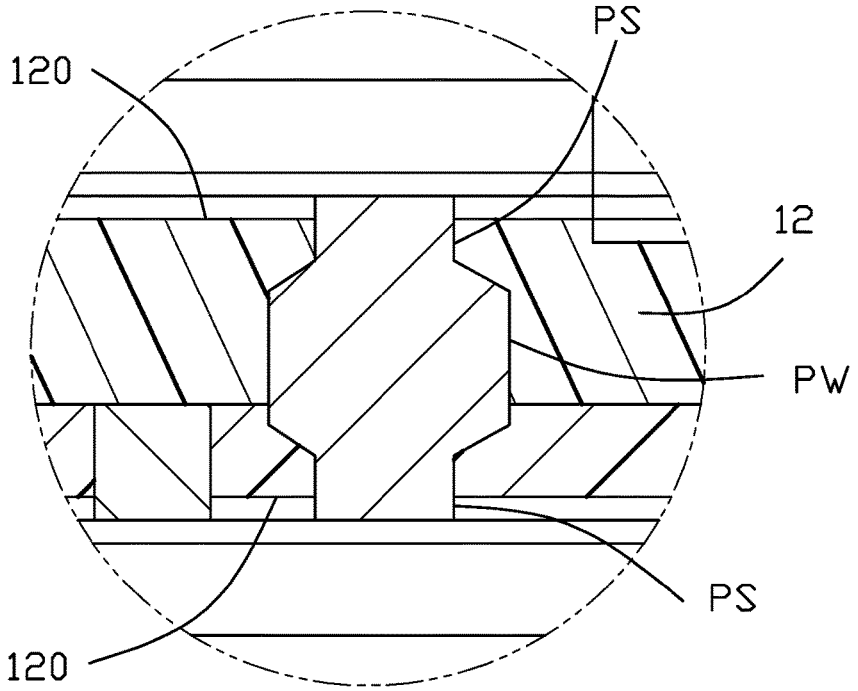
FIG. 11(A) is a partially enlarged cross-sectional view of the electrical connector of another embodiment showing the cross-section of the contacting section of the power terminal somewhat different from that in FIG. 11.

The upper power terminal P and the corresponding lower power terminal P are integrally formed into a block structure so that the power terminal P can have a maximum dimension in the case in the thickness direction of the tongue portion 12 where the width thereof is the same as the other conductive terminals 2, thereby enhancing the heat dissipation area to facilitate passing through the large current. At the same time, the dimension of each power terminal P in the thickness direction of the tongue portion 12 is at least twice the thickness of each grounding terminal G, so that metallic shielding plate 3 can be clamped, in the vertical direction, between the flat contacting section 21 of an upper grounding terminal G and the flat contacting section 21 of a corresponding lower grounding terminal G to make the grounding effect better. One feature of the invention is to have the power terminal P forms an angled deflection or transversely offset section around the retaining section toward the neighboring grounding terminal G while away from the inner signal terminal in the transverse direction. In addition, the power terminal P also forms a surface-mount horizontal tail section during stamping from sheet metal rather than in a bending/forming procedure. Differently and oppositely, in the signal terminal or the grounding terminal G, the similar angled deflection or the retaining section is made via the stamping procedure while the tail section is formed via the bending/forming procedure. FIG. 11(A) shows another embodiment wherein the power terminal has a pair of thinned structures PS located respectively around the mating surfaces 120 and measured in the transverse direction of the connector 100, so as to have the some contacting sections exposed upon the mating surfaces 120 of the tongue portion 12 as the first embodiment while having an embedded thickened middle section PW located between the pair of thinned structures in the thickness direction of the tongue portion 12 and measured in the transverse direction of the connector 100 for enhancement of the power delivery.

It is to be understood, however, that even though numerous characteristics and advantages of the present invention have been set forth in the foregoing description, together with details of the structure and function of the invention, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a terminal module comprising an insulative housing provided with a base portion and a tongue portion, an upper row of conductive terminals and a lower row of conductive terminals retained to the insulative housing, and a metallic shielding plate clamped between the upper and lower rows of conductive terminals;

each row of conductive terminals comprising a plurality of grounding terminals located on both sides of the tongue portion along a transverse direction, and a plurality of power terminals located on the inside of the grounding terminals;

each conductive terminal having a contacting section exposed to a surface of the tongue portion, a tail section, and a retaining section connecting the contacting section and the tail section;

wherein an upper power terminal and a corresponding lower power terminal are of an integral block structure and extending along a thickness direction of the tongue portion in the tongue portion, a dimension of the contacting section of each power terminal in said thickness direction of the tongue portion is at least twice the thickness of the contacting section of each grounding terminal; wherein said metallic shielding plate comprises a pair of flakes which are provided separately, each flake is clamped between one corresponding upper grounding terminal and one corresponding lower grounding terminal of the two rows of conductive terminals and is in contact with the upper and lower grounding terminals, and the pair of flakes are separated from the power terminals in the transverse direction.

2. The electrical connector as claimed in claim 1, wherein said two rows of conductive terminals are diagonally symmetrically arranged with each other, each row of conductive terminals comprise two power terminals.

3. The electrical connector as claimed in claim 1, wherein said thickness of each power terminal is not less than a thickness of the tongue portion.

4. The electrical connector as claimed in claim 1, wherein said contacting section and said retaining section of each power terminal are an upright shape whose thickness is larger than the width, the tail sections of two rows of conductive terminals are arranged in a row in a coplanar way.

5. The electrical connector as claimed in claim 1, wherein said insulative housing comprises a body portion integrated with the upper row of conductive terminals, the body portion is provided with a plurality of terminal slots for receiving the lower row of conductive terminals, the insulative housing further comprises an insulator integrated with the body portion.

6. The electrical connector as claimed in claim 1, wherein the contacting section of the corresponding upper grounding terminal and the contacting section of corresponding grounding terminal both extend longitudinally in a front-to-back direction in a flat manner to completely intimately sandwich the corresponding flake therebetween in the thickness direction of the tongue portion.

7. An electrical connector comprising:

a terminal module comprising an insulative housing provided with a base portion and a tongue portion defining opposite mating surfaces thereon, an upper row of conductive terminals and a lower row of conductive terminals retained to the insulative housing, and a metallic shielding plate residing between the upper and lower rows of conductive terminals;

each row of conductive terminals comprising a plurality of grounding terminals located on both sides of the tongue portion along a transverse direction, and a plurality of power terminals and a plurality of signal terminals located inside of the grounding terminals;

each conductive terminal having a contacting section exposed to the corresponding mating surface of the tongue portion, a tail section, and a retaining section connecting the contacting section and the tail section;

wherein an upper power terminal and a corresponding lower power terminal are joined together of an integral block structure as a unitary power terminal extending along a thickness direction of the tongue portion in the tongue portion, the contacting section of each power terminal penetrates the metallic shielding plate in the thickness direction, and a dimension of the contacting section of the unitary power terminal in said thickness direction of the tongue portion, is not less than a thickness of the tongue portion so as to be exposed to two corresponding mating surfaces of the tongue portion; wherein the power terminal has a pair of thinned structures located respectively around the mating surfaces and measured in the transverse direction of the connector, so as to have the contacting sections exposed upon the mating surfaces of the tongue portion as those of other terminals while having an embedded thickened middle section located between the pair of thinned structures in the thickness direction of the tongue portion and measured in the transverse direction of the connector for enhancement of the power delivery.

8. The electrical connector as claimed in claim 7, wherein said width of the contacting section of said unitary power terminal is not less than a width of the contacting section of each grounding terminal or each signal terminal.

9. The electrical connector as claimed in claim 7, wherein the grounding terminal in each row is discrete from the grounding terminal in the other row and cooperate with each other to commonly sandwich the shielding plate therebetween in a vertical direction perpendicular to said transverse direction.

10. The electrical connector as claimed in claim 7, wherein a thickness of the contacting section of the unitary power terminal is along the transverse direction while a thickness direction of the contact section of the signal terminal is along a vertical direction perpendicular to said transverse direction.

11. The electrical connector as claimed in claim 10, wherein said unitary power terminal includes an angled deflection directing toward the neighboring grounding terminal, and the corresponding tail section extends horizontally.

12. The electrical connector as claimed in claim 11, wherein the neighboring grounding terminal includes a widened section extends toward the corresponding power terminal, and a thickness direction of the contacting section of the neighboring grounding terminal extends along the vertical direction.

13. The electrical connector as claimed in claim 7, further including a pair of metallic flakes spaced from each other in a transverse direction perpendicular to both the front-to-back direction and the vertical direction and located at a mid-level of the tongue portion, wherein the grounding terminals are arranged in two rows with corresponding flat contacting sections extending in the front-to-back direction and completely intimately sandwiching the corresponding flakes in the vertical direction, respectively.

14. An electrical connector comprising:

an insulative housing including a base portion and a tongue portion forwardly extending from the base portion along a front-to-back direction, the tongue portion defining opposite upper and lower surfaces in a vertical direction perpendicular to said front-to-back direction;

a plurality of terminals in the housing and including power terminals, the grounding terminals and signal terminals, each of said terminals including a front contacting section exposed upon one of said opposite upper and lower surface of the tongue portion, a rear tail section and a middle retaining section between the front contacting section and the rear tails section; and a pair of metallic flakes spaced from each other in a transverse direction perpendicular to both the front-to-back direction and the vertical direction and located at a mid-level of the tongue portion, wherein the grounding terminals are arranged in two rows with the corresponding contacting sections extending longitudinally in the front-to-back direction in a flat manner and intimately sandwiching the corresponding flakes in the vertical direction, respectively.

15. The electrical connector as claimed in claim 14, wherein a thickness direction of the contacting section of the power terminal extends in a transverse direction perpendicular to both said front-to-back direction and the vertical direction while a thickness direction of the contacting section of the signal terminal extends in the vertical direction.

16. The electrical connector as claimed in claim 14, wherein the signal terminals are arranged in two rows with the corresponding contacting sections respectively exposed upon two opposite upper and lower surfaces of the tongue portion while the contacting section of each of the power terminals is exposed upon both said two opposite upper and lower surfaces of the tongue portion.

17. The electrical connector as claimed in claim 15, wherein the grounding terminal includes a widened section extending toward a transversely offset section of the neighboring power terminal in the transverse direction.

18. The electrical connector as claimed in claim 17, wherein a thickness direction of the grounding terminals extends in the vertical direction.

19. The electrical connector as claimed in claim 15, wherein each of said terminals made from sheet metal by stamping and bending processes wherein a dimension of the power terminal in a thickness direction of the tongue portion is at least twice a thickness of the single terminal; each of said terminals including a transversely offset section and a surface-mount horizontal tail section wherein in the power terminal the corresponding transversely offset section is made via forming and the corresponding horizontal tail section is made via direct stamping while in the grounding terminal the corresponding transversely offset section is made via direct stamping and the corresponding horizontal tail section is made via bending.

20. The electrical connector as claimed in claimed in claim 15, wherein each of said flakes is wider than the contacting sections of the corresponding grounding terminals in the transverse direction.

* * * * *